US006312234B1

(12) United States Patent
Okada

(10) Patent No.: US 6,312,234 B1
(45) Date of Patent: Nov. 6, 2001

(54) TURBO MOLECULAR PUMP

(75) Inventor: Takashi Okada, Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/128,710

(22) Filed: Aug. 4, 1998

(30) Foreign Application Priority Data

Aug. 13, 1997 (JP) ..... 9-231754

(51) Int. Cl.[7] ..... F04B 17/00
(52) U.S. Cl. ..... 417/423.4; 417/423.8
(58) Field of Search ..... 415/175, 180; 417/423.4, 423.8

(56) References Cited

U.S. PATENT DOCUMENTS 3,748,057 * 7/1973 Eskeli ..... 415/116
5,190,438 * 3/1993 Taniyama ..... 415/90
5,618,167 * 4/1997 Hirakawa ..... 417/372
5,707,213 * 1/1998 Conrad ..... 417/53

FOREIGN PATENT DOCUMENTS 2-3097 1/1990 (JP) .
8-93687 4/1996 (JP) .
9-72293 3/1997 (JP) .

* cited by examiner

*Primary Examiner*—Timothy S. Thorpe
*Assistant Examiner*—Ehud Gartenberg
(74) *Attorney, Agent, or Firm*—Adams & Wilks

(57) ABSTRACT

A turbo molecular pump comprises an electric component section having a motor, a base section supporting the electric component section, a shaft rotationally driven by the motor, and an impeller connected to the shaft for rotation therewith. A first cover member is connected to a lower portion of the base section. A second cover member is disposed in a lower portion of the electric component section and in contact with the first cover member for transferring heat generated within the electric component section to an exterior of the turbo molecular pump through the first cover member.

21 Claims, 6 Drawing Sheets

Fig. 3A
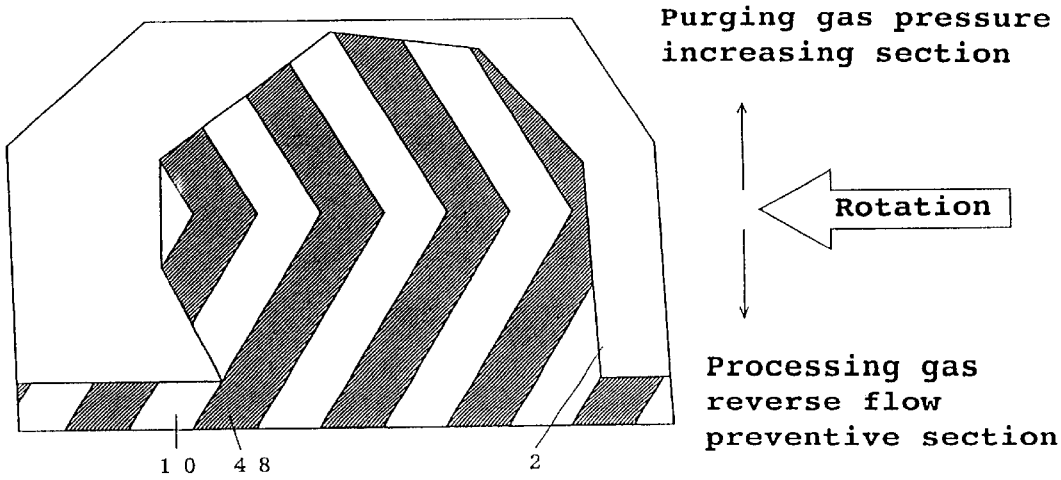
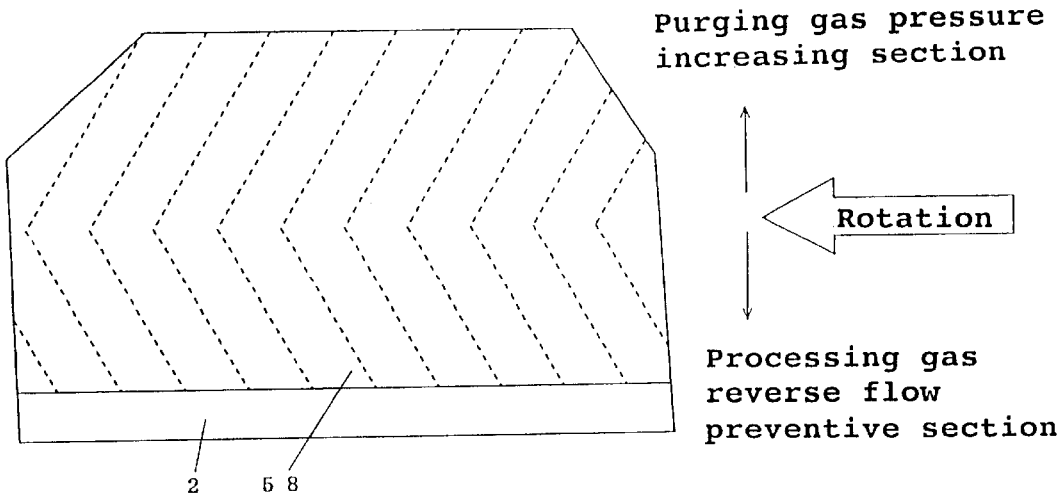
Fig. 3B

TURBO MOLECULAR PUMP

BACKGROUND OF THE INVENTION

1. Field of the Invention

The present invention relates to a turbo molecular pump, and in particular to a turbo molecular pump which can release heat generated by an impeller without cooling its base section.

2. Description of the Related Art

In case where aluminum chloride or the like is discharged from the turbo molecular pump, the inside of the turbo molecular pump may exceed the saturation vapor pressure where the solidification or adhesion of the produced material occurs. FIG. 6 shows an entire configuration of the turbo molecular pump. In FIG. 6, an impeller 2 is mounted on a rotational shaft 5 for rotation therewith. The impeller 2 is designed so as to rotate while being floated by a magnetic bearing. An electric component section is provided, which includes radial electromagnets 20, 21, radial position detectors 22, 23 and a motor 30 for rotationally driving the shaft. Especially at an impeller 2 and a screw-threaded spacer 4 near a discharge port 26, the solidification or adhesion of the aforementioned produced material is likely to occur around the electric component section. In order to avoid the solidification or adhesion of the produced material, conventionally, a heater band 8 is wound at the periphery of a base section 10 as shown in FIG. 7. However, the excessive heating by the heater band 8 may cause the plastic deformation of the impeller 2. In view of this, such a method is adopted in that a water-cooling pipe 12 is closely contacted with the base section 10. In addition, FIG. 7(A) is a longitudinally sectional view (partially schematic view) of the turbo molecular pump in which the heater band and the water-cooling pipe are disposed, and FIG. 7(B) is a sectional view taken along line 7B—7B of FIG. 7(A). As to the heater band 8 and the water-cooling pipe 12, the heater band 8 and an electromagnetic valve 14 determining the flow rate in the water-cooling pipe 12 are ON/OFF controlled so that the detected temperature by a temperature sensor 16 incorporated in the base section 10 becomes a temperature set by a temperature control circuit 18. With this control, the turbo molecular pump has been regarded such that it is possible to prevent the solidification or adhesion of the produced material while maintaining its performance.

However, if the discharged gas flow rate is set large, the conventional control of the heater band 8 and the electromagnetic valve 14 in the water-cooling pipe 12 may sometimes lead to the problem that the temperature of the impeller 2 becomes twice or more of the temperature set by the temperature control circuit 18 by increasing the discharged gas flow rate when the temperature sensor 16 senses the temperature set by the temperature control circuit 18. For example, if the temperature of the base section 10 is tried to be maintained in a range of from 60° C. to 80° C. under a condition that the discharged gas flow rate should exceed a permissible value, there may arise a case that the temperature of the impeller 2 exceeds its heat-resisting temperature. If this condition lasts for a long time, the stress resistance of the impeller 2 is lowered and the impeller 2 may break may be broken. Therefore, in order to avoid the abnormally high temperature of the impeller 2, the power of the motor 30 must be lowered, or the discharged gas flow rate must be restricted.

The cooling of the impeller 2 is mainly relied on the following two phenomena: The first one is for a case where the discharged gas flow rate is small, and of the heat transmission due to radiation from the impeller 2 to the base section 10 or the envelope 11. The second one is for a case where the discharged gas flow rate is large, and of the heat transmission through the discharged gas by the heat transfer from the impeller 2 to the base section 10 or the envelope 11. These radiated and transferred heats are cooled as a consequence of cooling the base section 10 or the envelope 11.

However, if the generated heat of the impeller 2 is large but the discharged gas flow rate is small, for example in case of no load under a magnetic field, then sufficient heat transmission by the radiation cannot be expected, and the temperature of the impeller 2 may become high.

SUMMARY OF THE INVENTION

The present invention is made in view of the problems encountered in the conventional art, and an object of the present invention is to provide a turbo molecular pump which can release heat generated in an impeller without cooling a base section.

To attain the above-noted object, according to the present invention, a turbo molecular pump is characterized by comprising: an electric component section including at least a motor; a base section supporting the electric component section; a shaft rotated by the motor; and an impeller fixed to the shaft. The present invention further comprises cooling means for cooling the electric component section, the impeller and the shaft without cooling the base section. The cooling means includes means for cooling only the heat generated in the motor of the electric component section, the impeller and the shaft without cooling the base section in order to prevent solidification or adhesion of the produced material, and more specifically, includes all means by which the generated heat can be absorbed or released through gaseous or liquefied medium.

By this arrangement, it is possible to externally release the heat generated within the electric component section while preventing the solidification and adhesion of the produced material, so that the permissible flow rate or the like can be improved.

Further, the present invention is characterized in that the cooling means is constructed by an arrangement that a bottom cover disposed in a bottom portion of the base section is contacted with a bottom surface of a casing disposed in a bottom portion of the electric component section. The bottom cover is exposed to the external air and thus the heat within the electric component section is subjected to the natural-draft cooling. Further, the heat within the electric component section can be easily radiated.

Further, the present invention is characterized in that a forcible cooling section of water cooling, oil cooling or forcible air cooling is fixed or detachably provided to be contacted with an outside of the bottom cover. By this arrangement, it is possible to easily absorb the heat within the electric component section in an external portion. Since the forcible cooling section is disposed outside the turbo molecular pump, the attachment and detachment thereof can be easily made.

Here, although it may be conceivable that the upper portion or peripheral portion of the electronic component section can be cooled by water cooling, according to the present invention it is also possible to arrange the cooling means such that a casing side cylinder disposed around the electric component section is extended toward a bottom cover disposed in a bottom of the base section, and a forcible cooling section of water cooling, oil cooling or forcibly air cooling is fixed or detachably provided in a space defined by the bottom cover, the casing side cylinder and a bottom surface of a casing disposed in a bottom of the electric component section.

By this arrangement, the structural modification from the conventional turbo molecular pump can be minimized.

Note here that the forcible cooling section may be constructed in various ways as far as it absorbs the heat generated in the electric component section and releases that heat therefrom externally. For example, a water-cooling pipe may be disposed to be contacted with or to be closer to the casing bottom surface, or a formed space may be filled entirely with water. Although the water-cooling pipe should not be limited in shape and length, it is preferable that the water-cooling pipe is configured to provide larger contact area with the casing bottom surface. Further, the medium should not be restricted to water, and any other liquefied or gaseous medium having a large heat exchange effect can be used.

Further, according to the present invention, the cooling means is arranged so that at least one stage purging gas pressure increasing section having at least one inclined groove is provided for increasing pressure in the vicinity of a stator by rotation of the shaft and the impeller in a flow path of purging gas. In the purging gas pressure increasing section, one or more inclined groove(s) is disposed. This inclined groove serves to suppress the discharge of the purging gas as the shaft and the impeller rotate, and thus increases pressure in the vicinity of the stator. The purging gas pressure increasing section can be disposed at any arbitrary portion in the flow path of the purging gas, and it is possible to dispose one or more stage(s) of purging gas pressure increasing section(s) along the flow path of the purging gas. By increasing the pressure in the vicinity of the stator, the heat exchange effect between the impeller and the shaft, and the electric component section can be enhanced.

Further, according to the present invention, the cooling means is arranged to have at least one stage purging gas pressure increasing section having at least one inclined groove for increasing pressure in the vicinity of a stator by rotation of the shaft and the impeller in a flow path of purging gas, and at least one stage processing gas reverse flow preventive section having at least one inclined groove for preventing reverse flow of processing gas. In the flow path of the purging gas, the processing gas reverse flow preventive section is provided in addition to the purging gas pressure increasing section. The processing gas reverse flow preventive section is formed with one or more inclined groove(s). As the shaft and the impeller rotate, the inclined groove(s) serves to prevent the processing gas from flowing reversely. By preventing the processing gas from entering into the electric component section, it is possible to prevent corrosion by the processing gas in the electric component section. The inclined groove may have an inclination required for increasing pressure in the vicinity of the stator and an inclination required for preventing the reverse flow of the processing gas when the impeller rotates. The inclined groove may not be formed without limiting in shape, size, length, number and so on.

Further, according to the present invention, a heat insulating material is partially or entirely interposed in an annular manner between a casing side cylinder disposed around the electric component section and the base section. The heat insulating material thus disposed renders the base section not to be adversely affected by the cooling of the electric component section. Since the base section is not cooled, the radiated heat from the heater band or processing gas never escape to the base section, and therefore it is possible to surely avoid the solidification and adhesion of the produced material.

BRIEF DESCRIPTION OF THE DRAWINGS

In the accompanying drawings:

FIG. 3(A) is a view showing a portion indicated by arrow D–E of FIG. 2.; according to one embodiment, and FIG. 3(B) is a view showing a portion indicated by arrow D–E of FIG. 2 according to another embodiment;

DETAILED DESCRIPTION OF THE PREFERRED EMBODIMENTS

Figure 1:
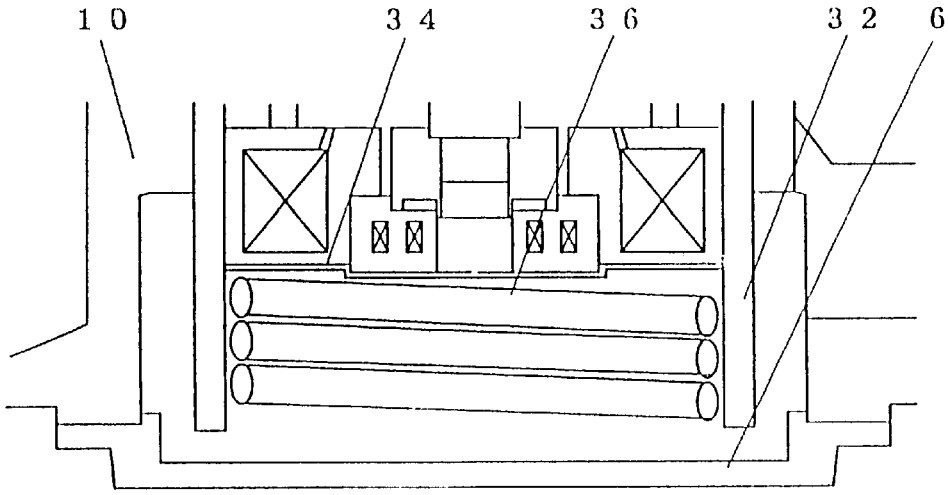
FIG. 1 is a partially enlarged view showing a first embodiment of the present invention.
Figure 6:
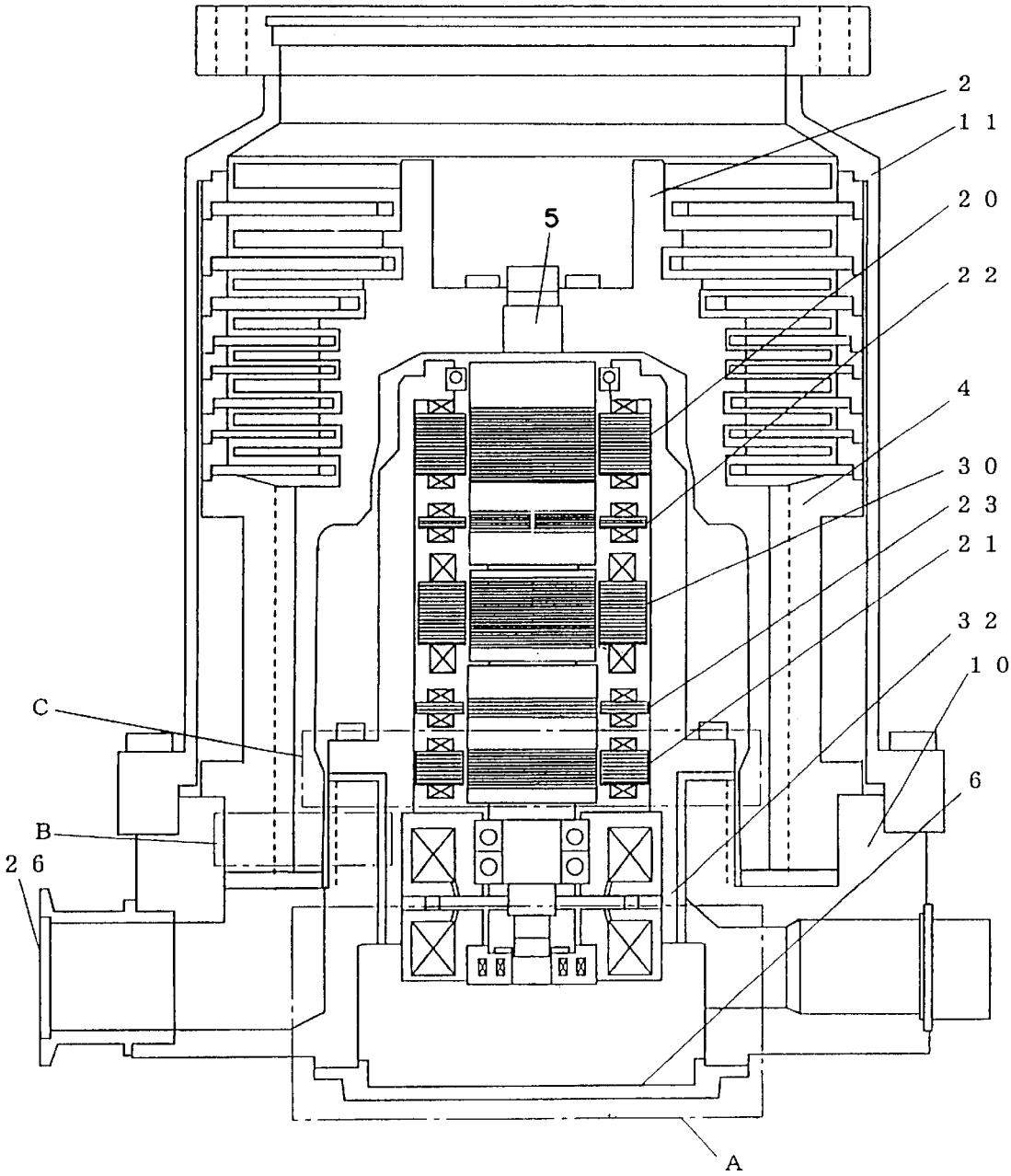
Fig. 6 PRIOR ART
FIG. 6 shows an entire configuration of a conventional turbo molecular pump.
Figure 7A:
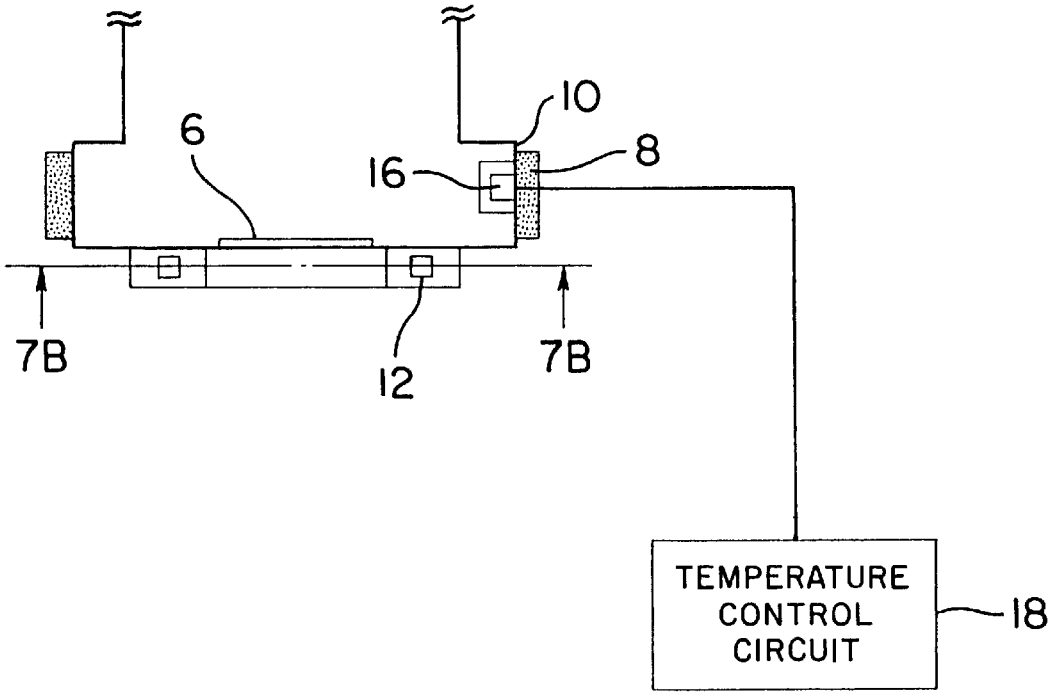
FIG. 7A PRIOR ART
FIG. 7(A) is a longitudinally sectional view of a conventional turbo molecular pump in which a heater band and a water-cooling pipe are disposed.
Figure 7B:
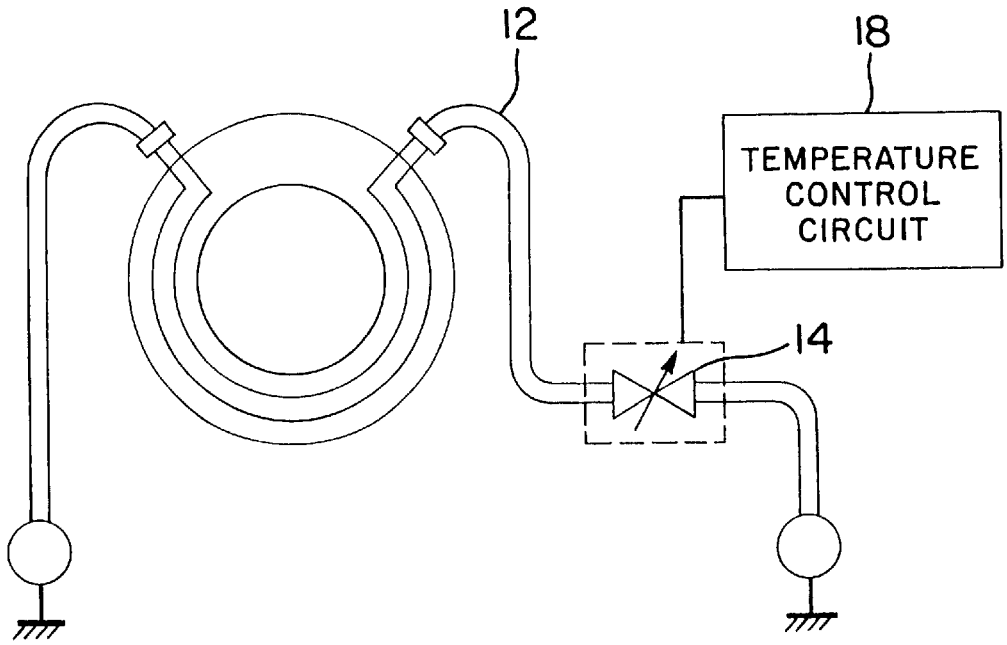
FIG. 7B PRIOR ART
FIG. 7(B) is a sectional view taken along line 7B—7B of FIG. 7(A).

Preferred embodiments of the present invention will now be described with reference to the drawings. FIG. 1 shows a first embodiment of the present invention, which is an enlarged view of a region indicated by A in FIG. 6. A casing-side cylinder 32 is extended more downwardly than that of the conventional one. In a space defined by the casing-side cylinder or cylindrical casing 32, a cover member or casing bottom surface 34 and a cover member or bottom cover 6, a water-cooling pipe 36 arranged in a coil manner is disposed to contact with the casing bottom surface 34. In the embodiments described herein, the electric component section of the turbo molecular pump is as shown in the conventional turbo molecular pump of FIG. 6 and includes radial electromagnets 20, 21, radial Next, an operation will be described.

In the aforementioned structure, water flowing in the water-cooling pipe 36 can absorb heat generated within the electric component section, and therefore the heat can be released or radiated externally. On the other hand, the extended casing-side cylinder 32 prevents the base section 10 from being directly cooled, to thereby avoid the solidification and adhesion of the produced material caused due to the direct cooling of the base section 10. Consequently, it prevents the impeller 2 from generating heat, and thus the life time and reliability of the impeller are improved. Further, since the impeller 2 is prevented from generating an abnormally high temperature, it is possible to relieve the restriction in pump flow rate and so on. Furthermore, the water-cooling pipe 36 can be easily attached and detached, and the heat exchange effect thereof is high.

Although not shown in the drawings, by contacting the casing bottom surface 34 with the bottom cover 6 or by approaching to each other, the generated heat within the electric component section can be easily released externally through the bottom cover 6. The radiated heat or the transmitted heat from the casing bottom surface 34 directly reaches the bottom cover 6, and thus never cools the base section 10. In this case, the water-cooling pipe 36 may be omitted, but the further cooling effect to the electric component section can be expected with the combination of the water-cooling pipe 36.

Moreover, although not shown in the drawings, a water-cooling pipe may be in contact with the outside of the bottom cover 6 in place of the water-cooling pipe 36. In this case, the heat generated within the electric component section is absorbed by the water-cooling pipe. The water-cooling pipe may be fixed, or otherwise may be detachably mounted since it is disposed outside the turbo molecular pump.

Figure 2:
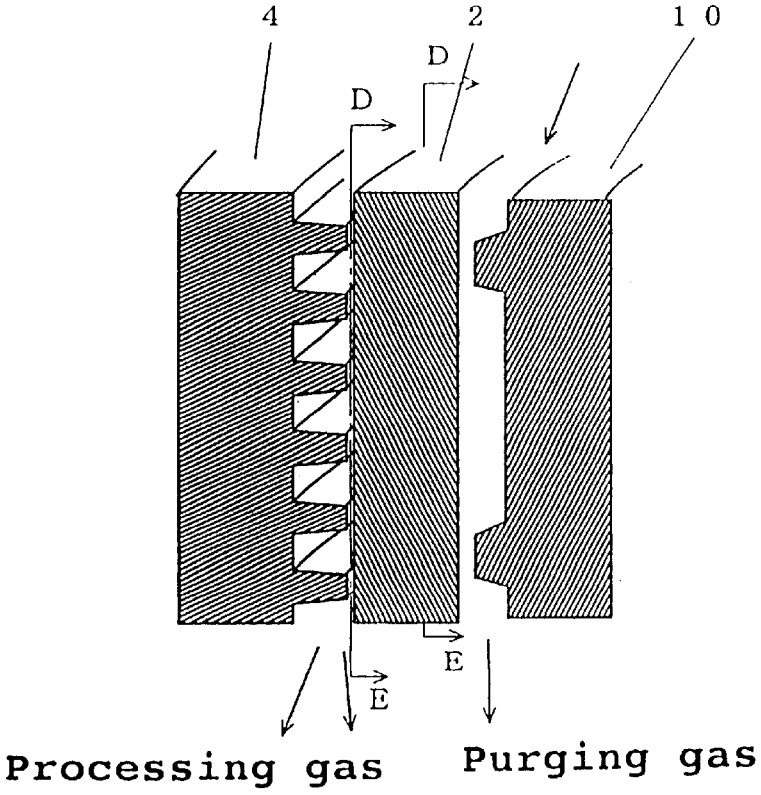
FIG. 2 is a partially enlarged view showing a second embodiment of the present invention.

Next, a second embodiment of the present invention will be described. FIG. 2, which illustrates the second embodiment, is a perspective, sectional view showing, in an enlarged manner, a region indicated by B in FIG. 6. A screw-threaded spacer 4 has a side which is confronted with the impeller 2 and which is formed with screw-like threads. On the other hand, the base section 10 has a side which is located opposite from the spacer 4 with respect to the impeller 2, and which is formed with grooves 48 as indicated in FIG. 3(A). FIG. 3(A) shows a portion indicated by arrows D–E in FIG. 2.

Next, an operation will be described.

Figure 4:
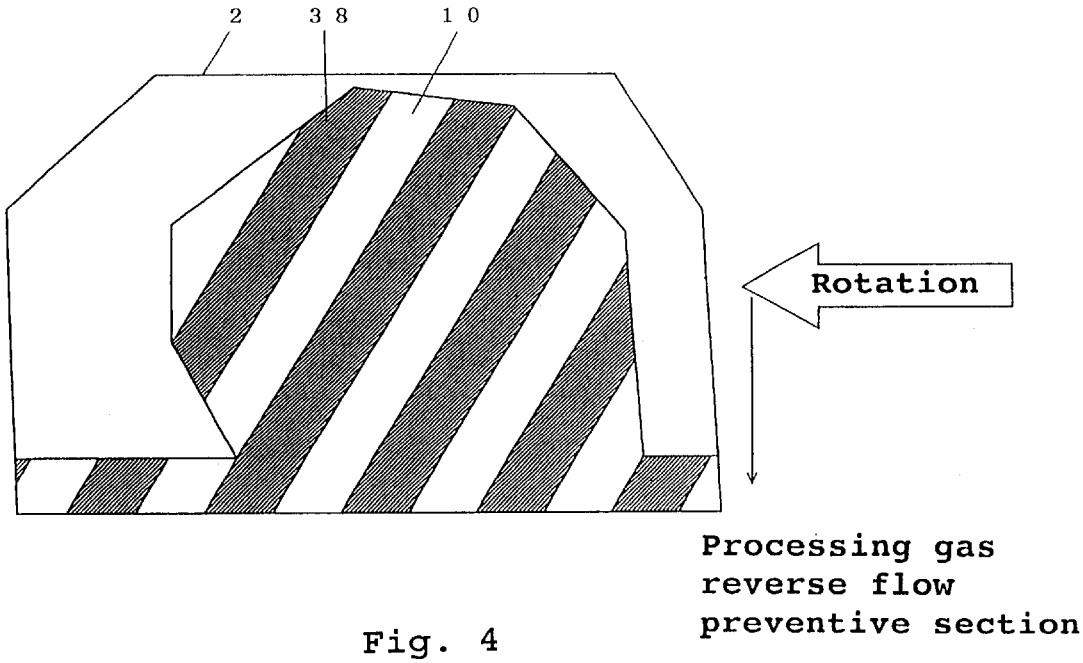
Fig. 4 PRIOR ART
FIG. 4 shows a base section in which grooves are conventionally formed.

To make easier the comparison to FIG. 3(A), FIG. 4 illustrates the base section 10 in which grooves 38 are formed as conventionally. In association with the rotation of the impeller 2 in the direction indicated by the arrow, the purging gas is downwardly pushed out by the spirally formed grooves 38. On the other hand, since the upper section is communicated with the casing incorporating the electric component section therein, it is designed so that the processing gas hardly flows in the reverse direction into the electric component section. In case where the processing gas is composed of a chlorine group, the processing gas has high corrosiveness and, therefore, it must be prevented from entering into the electric component section. However, the electric component section is in a condition where the pressure of the purging gas is low, i.e. a condition where the heat exchange effect is lowered since the number of the molecules in the purging gas is smaller as the pressure of the purging gas is lower. In contrast, in the embodiment of the present invention, a plurality of V-shaped grooves 48 are threadingly formed on the base section 10 such that an apex or bent portion of each V-shaped groove 48 is oriented in the direction opposite to the rotating direction of the impeller 2 as shown in FIG. 3(A). As a result, since the lower half of the V-shaped grovees are oriented in the same direction as that shown in FIG. 4, the processing gas is prevented from reversely flowing to enter into the electric component section as the impeller 2 rotates, whereas since the upper half of the V-shaped grooves 48 are oriented in the opposite direction from that of FIG. 4, the pressure of the purging gas within the electric component section can be increased. Further, V-shaped grooves 58 may be threadingly formed on the side of the impeller 2 confronted with the base section 10 as shown in FIG. 3(B) which is another embodiment of FIG. 3(A). In this case, an apex or bent portion of each V-shaped groove 58 is oriented in the same direction as the rotating direction of the impeller 2, to provide the same effect as that of FIG. 3(A). That is, with this arrangement, it is possible to improve the heat exchange effect by the purging gas while preventing the reverse flow of the processing gas, to thereby make it possible to cool the electric component section.

Figure 5:
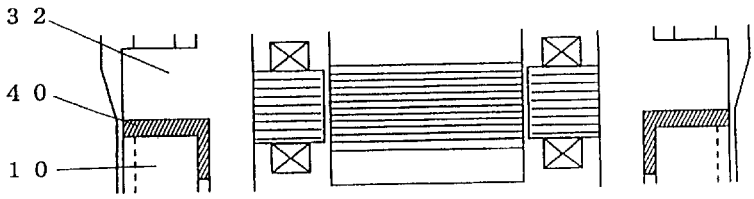
FIG. 5 is a partially enlarged view showing a third embodiment of the present invention.

Next, a third embodiment of the present invention will be described. FIG. 5, which shows the third embodiment of the present invention, is a partially sectional, enlarged view of a region indicated by C in FIG. 6. In FIG. 5, a heat insulating material 40 is arranged between the base section 10 and the casing side cylinder 32 in an annular manner. The heat insulating material 40 is made, for instance, of stainless steel which is high in anti-corrosion property and low in heat conductivity.

With this arrangement, it is possible to cool the electric component section only, without cooling the base section 10.

In addition, the first to second embodiments may be used independently from one another, but if combined together, then it is possible to effectively further cool only the electric component section, without cooling the base section 10.

As described above, according to the present invention, with the provision of the cooling means, it is possible to cool the heat generated in the impeller without cooling the base section, and thus, the life of the impeller can be made long, and the reliability of the impeller can be enhanced.

Further, according to the present invention, since the bottom cover is contacted with the casing bottom surface, the heat within the electric component section can be released externally by radiation.

Further, according to the present invention, since the forcible cooling section is contacted with the outside of the bottom cover, the heat within the electric component section can be easily absorbed by the external portion. Since the forcible cooling section is disposed outside the turbo molecular pump, the attachment and detachment thereof can be easily made.

Further, according to the present invention, since the casing side cylinder is extended, and the forcible cooling section is disposed, it is possible to cool the electric component section without modifying the structure of the turbo molecular pump on a large scale.

Further, according to the present invention, since the purging gas pressure increasing section is provided within the flow pass of the purging gas, it is possible to utilize the purging gas also as a cooling source, thereby providing an excellent energy saving property.

Further, according to the present invention, since the purging gas pressure increasing section and the processing gas reverse flow preventive section are provided within the flow path of the purging gas, the heat exchange effect can be enhanced as much as possible while the reverse flow of the processing gas can be avoided.

Further, according to the present invention, since the heat insulating material is interposed between the casing side cylinder and the base section, only the electric component section can be cooled with further improved efficiency.

What is claimed is:

1. A turbo molecular pump comprising: an electric component section having a motor; a base section supporting the electric component section; a shaft rotationally driven by the motor; an impeller connected to the shaft for rotation therewith; and cooling means for cooling the electric component section and the shaft without cooling the base section, the cooling means comprising a first cover member connected to a lower portion of the base section, and a second cover member disposed in a lower portion of the electric component section and in contact with the first cover member for transferring heat generated within the electric component section to an exterior of the turbo molecular pump through the first cover member.

2. A turbo molecular pump according to claim 1; wherein the cooling means further comprises a cooling pipe for circulating a cooling fluid and disposed in contact with the first cover member from the exterior of the turbo molecular pump.

3. A turbo molecular pump comprising: an electric component section having a motor; a base section supporting the electric component section; a casing disposed around the electric component section; a first cover member connected to a lower portion of the base section; a second cover member disposed in a lower portion of the electric component section; a shaft rotationally driven by the motor; an impeller connected to the shaft for rotation therewith; and a cooling pipe disposed in a space bounded by the casing, the first cover member and the second cover member for circulating a cooling fluid to cool the electric component section and the shaft without cooling the base section.

4. A turbo molecular pump according to claim 2; wherein the cooling fluid comprises cooling water.

5. A turbo molecular pump according to claim 2; wherein the cooling fluid comprises cooling oil.

6. A turbo molecular pump according to claim 2; wherein the cooling fluid comprises cooling air.

7. A turbo molecular pump according to claim 2; further comprising a casing enclosing the electric component section; and wherein the casing, the first cover member and the second; cover member define an enclosure housing the cooling pipe.

8. A turbo pump according to claim 2; wherein the cooling pipe is generally coil-shaped.

9. A turbo molecular pump according to claim 3; wherein the cooling fluid comprises cooling water.

10. A turbo molecular pump according to claim 3; wherein the cooling fluid comprises cooling oil.

11. A turbo molecular pump according to claim 3; wherein the cooling fluid comprises cooling air.

12. A turbo molecular pump according to claim 3; wherein the cooing pipe is generally coil-shaped.

13. A turbo molecular pump comprising: an electric component section having a motor; a cover member disposed in a lower portion of the electric component section; a casing for housing the electric component section; a base section for supporting the electric component section; a shaft connected to be rotationally driven by the motor; an impeller mounted on the shaft for rotation therewith; and a cooling pipe in contact with the cover member for circulating a cooling fluid to cool the electric component section.

14. A turbo molecular pump according to claim 13; wherein the casing has a portion extending from the cover member for housing the cooling pipe.

15. A turbo molecular pump according to claim 1; wherein the electric component section and the shaft do not contact the base section.

16. A turbo molecular pump according to claim 2; further comprising a casing housing the electric component section, the casing having a portion extending from the second cover member for housing the cooling pipe.

17. A turbo molecular pump according to claim 3; wherein the casing has a portion extending from the second cover member for housing the cooling pipe.

18. A turbo molecular pump according to claim 3; wherein the electric component section and the shaft do not contact the base section.

19. A turbo molecular pump according to claim 13; wherein the electric component section and the shaft do not contact the base section.

20. A turbo molecular pump comprising: an electric component section having a motor; a base section supporting the electric component section; a cover member disposed in a lower portion of the electric component section; a casing housing the electric component section, the casing having a portion extending from the cover member in a direction away from the electric component section to define a space bounded by at least the cover member and the portion of the casing; a shaft rotationally driven by the motor; an impeller connected to the shaft for rotation therewith; and a cooling pipe disposed in the space bounded by the cover member and the portion of the casing for circulating a cooling fluid to cool the electric component section and the shaft without cooling the base section.

21. A turbo molecular pump according to claim 20; wherein the electric component section and the shaft do not contact the base section.

* * * * *

UNITED STATES PATENT AND TRADEMARK OFFICE

CERTIFICATE OF CORRECTION

PATENT NO. : 6,312,234 B1
DATED : November 6, 2001
INVENTOR(S) : Takashi Okada

It is certified that error appears in the above-identified patent and that said Letters Patent is hereby corrected as shown below:

Column 4,
Line 43, insert:
-- position detectors 22, 23 and a motor 30. -- after “radial”.

Signed and Sealed this

Eighteenth Day of May, 2004

JON W. DUDAS
*Acting Director of the United States Patent and Trademark Office*